US008806669B2

(12) United States Patent
Halloran et al.

(10) Patent No.: US 8,806,669 B2
(45) Date of Patent: Aug. 19, 2014

(54) TOILET FLUSH VALVE WITH REDUCING CROSS SECTION VALVE SEAT

(75) Inventors: Daniel N. Halloran, Saukville, WI (US); Ronald L. Smies, Oostburg, WI (US)

(73) Assignee: Kohler Co., Kohler, WI (US)

( * ) Notice: Subject to any disclaimer, the term of this patent is extended or adjusted under 35 U.S.C. 154(b) by 352 days.

(21) Appl. No.: 12/416,179

(22) Filed: Apr. 1, 2009

(65) Prior Publication Data

US 2009/0255043 A1 Oct. 15, 2009

Related U.S. Application Data

(60) Provisional application No. 61/043,817, filed on Apr. 10, 2008.

(51) Int. Cl.
*E03D 1/34* (2006.01)

(52) U.S. Cl.
USPC ..... 4/378; 4/399; 4/400

(58) Field of Classification Search
USPC ..... 4/391, 378, 390, 399, 397, 400, 401
See application file for complete search history.

(56) References Cited

U.S. PATENT DOCUMENTS

| | | | | |
|---|---|---|---|---|
| 206,370 | A | 7/1878 | Turton | |
| 1,077,457 | A * | 11/1913 | Delany | 4/390 |
| 1,307,391 | A * | 6/1919 | Bush | 4/378 |
| 2,011,782 | A | 8/1935 | Teahen | |
| 2,372,848 | A | 4/1945 | Owens | |
| 2,613,367 | A | 10/1952 | Denham | |
| 3,172,129 | A | 3/1965 | Fulton et al. | |
| 3,555,572 | A * | 1/1971 | Thomas | 4/399 |
| 3,890,652 | A | 6/1975 | Fulton | |
| 3,916,455 | A | 11/1975 | Longdin | |
| 4,433,446 | A | 2/1984 | Grimistad | |
| 5,305,474 | A | 4/1994 | Nardi et al. | |
| 5,329,647 | A | 7/1994 | Condon | |
| 5,896,593 | A | 4/1999 | Mizrahi | |
| 5,926,861 | A * | 7/1999 | Frost | 4/378 |
| 6,199,221 | B1 | 3/2001 | Stahlhut | |
| 6,715,162 | B2 | 4/2004 | Han et al. | |
| 6,728,975 | B2 * | 5/2004 | Han | 4/378 |
| 6,728,976 | B1 | 5/2004 | Halloran et al. | |
| 6,785,913 | B2 | 9/2004 | Ho | |
| 7,155,751 | B2 | 1/2007 | Antunez | |
| 7,634,821 | B2 * | 12/2009 | Denzin | 4/378 |
| 2004/0040076 | A1 | 3/2004 | Han et al. | |
| 2004/0040080 | A1 | 3/2004 | Prokopenko et al. | |
| 2007/0101485 | A1 * | 5/2007 | Denzin | 4/378 |
| 2008/0052812 | A1 * | 3/2008 | Jensen | 4/378 |

FOREIGN PATENT DOCUMENTS

| | | |
|---|---|---|
| JP | 2005/105519 | 4/2005 |
| MX | PA05002333 | 6/2005 |
| RU | 2248487 C1 | 3/2005 |
| TW | 284817 | 9/1996 |

OTHER PUBLICATIONS 7 pages of an excerpt from Sep. 14, 2009 PCT search report from PCT/US2009/002183, a corresponding PCT application.

* cited by examiner

*Primary Examiner* — Gregory Huson
*Assistant Examiner* — Lauren Heitzer
(74) *Attorney, Agent, or Firm* — Foley & Lardner LLP

(57) ABSTRACT

A canister flush valve is disclosed with a valve seat modified to accommodate a greater initial surge of flow, without distorting flushing performance. There is a mounting at the bottom of a toilet tank that links to an outlet hole from the tank and forms a valve seat. A passageway through the mounting tapers in an arcuate manner below the valve seat. There is also a guide support structure in the passageway, preferably centered. The guide support structure also has a tapered leg.

23 Claims, 6 Drawing Sheets

FIG. 10
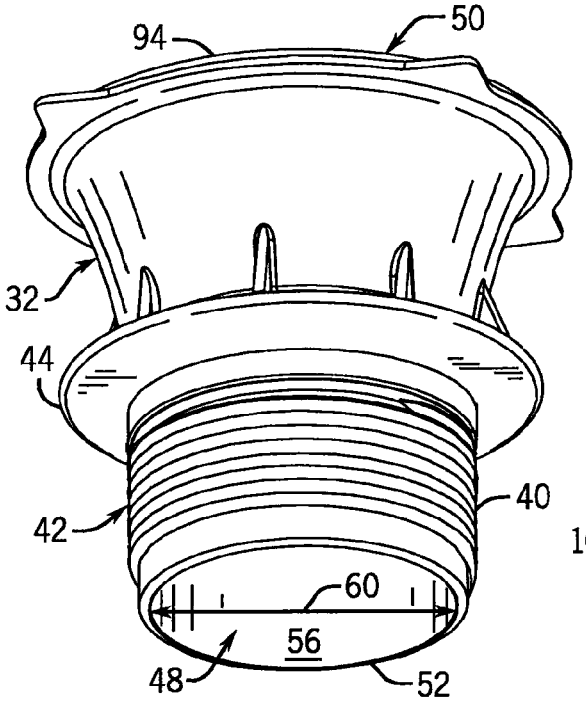
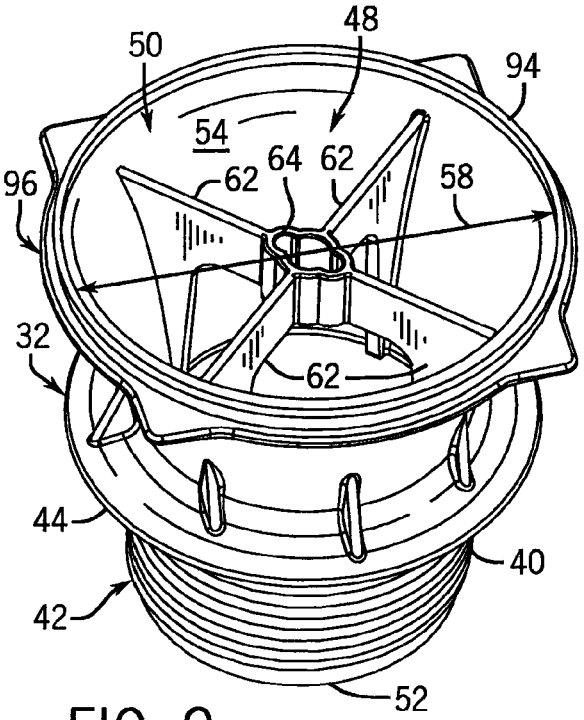
FIG. 9
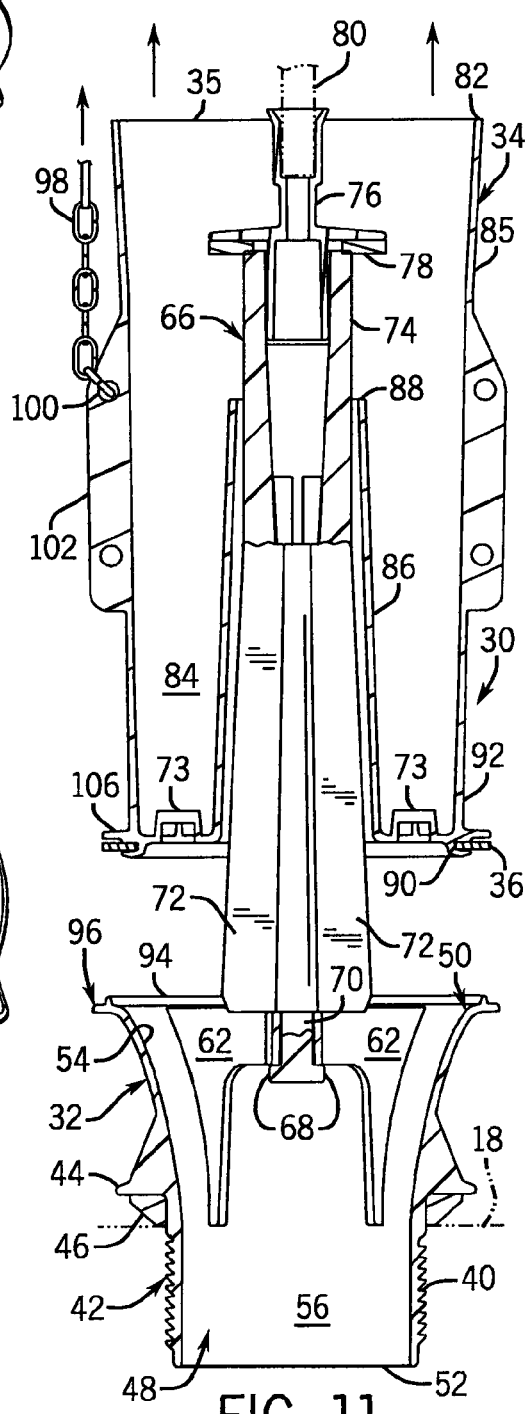
FIG. 11

TOILET FLUSH VALVE WITH REDUCING CROSS SECTION VALVE SEAT

CROSS-REFERENCE TO RELATED APPLICATIONS

This application claims priority based on U.S. provisional application 61/043,817 which was filed Apr. 10, 2008.

STATEMENT OF FEDERALLY SPONSORED RESEARCH OR DEVELOPMENT

Not applicable.

BACKGROUND OF THE INVENTION

The present invention relates to flush valves that control the flow of water from toilet tanks to toilet bowls. More particularly, the invention relates to a tank valve seat mountable to a toilet tank and preferably used with canister type flush valves.

Many systems for controlling the flow of toilet tank water to a toilet bowl are known. Such systems have a water inlet valve connected to the tank that is typically controlled by a float that reacts to the tank water level. Depressing a trip lever or other actuator moves a flush valve at the tank outlet so that water can empty from the tank into the bowl. As the tank water drains, an inlet valve float drops with the water level in the tank, thereby triggering inlet water flow to refill the tank. After sufficient tank water leaves the tank, the flush valve closes so that the water level in the tank can be re-established. As the tank refills after the outlet valve has closed, the supply valve float rises with the water and eventually closes the supply valve to shut off the water supply.

A variety of flush valves have been devised for controlling the flow of water from the tank to the bowl. One of the most common is the flapper type flush valve. Flapper flush valves have a pivotal yoke that supports a large diameter stopper that seals off the tank outlet until the trip lever is actuated to start a flush cycle. The large stopper is filled with air that slows the reseating of the stopper until sufficient water has been drained from the tank. On occasion, some such valves have difficulty in completely closing off outlet flow if the flapper doesn't drop onto the valve seat exactly right.

Another type of flush valve has a dedicated float that moves straight vertically upwards once tripped, and then straight vertically downward. See eg. U.S. Pat. Nos. 5,329,647, 5,896,593, 6,715,162, and 6,728,976.

A particularly preferred type of flush valve that works in this manner is the canister flush valve shown in U.S. patent application publication 2007/0101485, which is hereby incorporated by reference as if fully set forth herein. However, this type of canister design, when used with its shown valve seat, presents a number of design constraints.

For example, to achieve sufficient initial flow one may have to increase the diameter of the entry to the bowl's rear extension to a point where non-standard fittings are required, and/or aesthetics are affected. Moreover, the flow characteristics may be such as to limit certain water usage efficiencies that must be compensated for otherwise.

One complicating factor is that in order to insure vertical movement of the valve body, a guide is positioned on the valve seat. As this is typically at the center of the flow passage through the seat, the guide itself can impede flow and complicate design revisions. While U.S. Pat. No. 5,926,861 proposes to have the guide for the canister be at the periphery of the seat, it requires a relatively complex and expensive structure to implement that proposal.

In light of the above, improvements are needed to address these concerns.

SUMMARY OF THE INVENTION

The present invention covers in one aspect a flush valve for controlling a flow of water out through a hole in a wall of a toilet tank. The flush valve has a mounting having a lower end suitable for facilitating installation of the mounting adjacent the hole, an upper end in a form of a valve seat, and a through passage extending down from the valve seat. It also has a guide portion mounted in the through passage and extending upward there from.

There is also a valve body positionable over the valve seat so as to be suitable to inhibit water flow through the mounting when in a first position where the valve body is positioned on the valve seat, and so as to be suitable to permit water flow through the mounting when the valve body is in a second position where the valve body is not positioned on the valve seat. In accordance with the present invention the through passage tapers below the valve seat.

In preferred forms the through passage arcuately narrows below the valve seat from a diameter above 2.9 inches to a diameter below 2.3 inches, more preferably below 2.1 inches, the valve body is a canister type valve body, the guide portion has a lower leg structure that tapers arcuately below the valve seat, and the mounting has external threads proximate a lower end of the mounting so as to facilitate installation of the mounting through the tank hole. Alternatively, when a one-piece style toilet is involved with a blind attachment hole, instead of threading the lower end of the structure one can use a bayonet style attachment system like that of U.S. Pat. No. 4,433,446.

It will be appreciated that the enlarged valve seat and correspondingly large canister valve produces a large discharge flow rate of water to enter as soon as the canister valve is lifted off the valve seat. The tapering of the passageway below the valve seat (and the corresponding tapering of the guide portion) then permit the flow to be smoothly transitioned to the desired size with no impedance to the developed flow rate.

In another aspect the invention provides a mounting useful as part of such a flush valve. That mounting may have a body in the form of a sleeve and have a lower end suitable for facilitating installation of the body adjacent a tank wall outlet hole. The mounting also has an upper end in a form of a valve seat, a through passage extending down from the valve seat, and a guide post mounted in the through passage and extending upward there from. The through passage tapers below the valve seat.

It should be noted that the guide post can be centered along the center line of the canister valve body for optimal guiding. This is also a cost effective way of achieving the guiding. However, adequate flow can occur past the guide portion, even in connection with low flush toilets.

In another aspect the invention provides a toilet (with tank and bowl), where the above flush valve controls outflow from the tank to the bowl.

Hence, the present invention improves the performance of conventional, high performance, canister valves so as to permit an uncompromised discharge flow rate of water to quickly pass into the toilet once flushing has started. This is achieved at relatively low cost, and in a manner that does not require the bowl rear extension to be widened to accommodate the greater flow.

These and other advantages of the invention will be apparent from the detailed description and drawings. What follows are one or more preferred embodiments of the present invention. To assess the full scope of the invention the claims should be looked to as the preferred embodiment(s) are not intended as the only embodiment(s) within the scope of the invention.

BRIEF DESCRIPTION OF THE DRAWINGS

FIG. 9 is an enlarged top perspective view of a preferred mounting of the present invention;

FIG. 10 is a bottom perspective view of the FIG. 9 mounting; and

FIG. 11 is a view similar to FIG. 6, but showing the canister valve body raised to a second position off the valve seat.

DETAILED DESCRIPTION OF THE PREFERRED EMBODIMENTS

Figure 1:
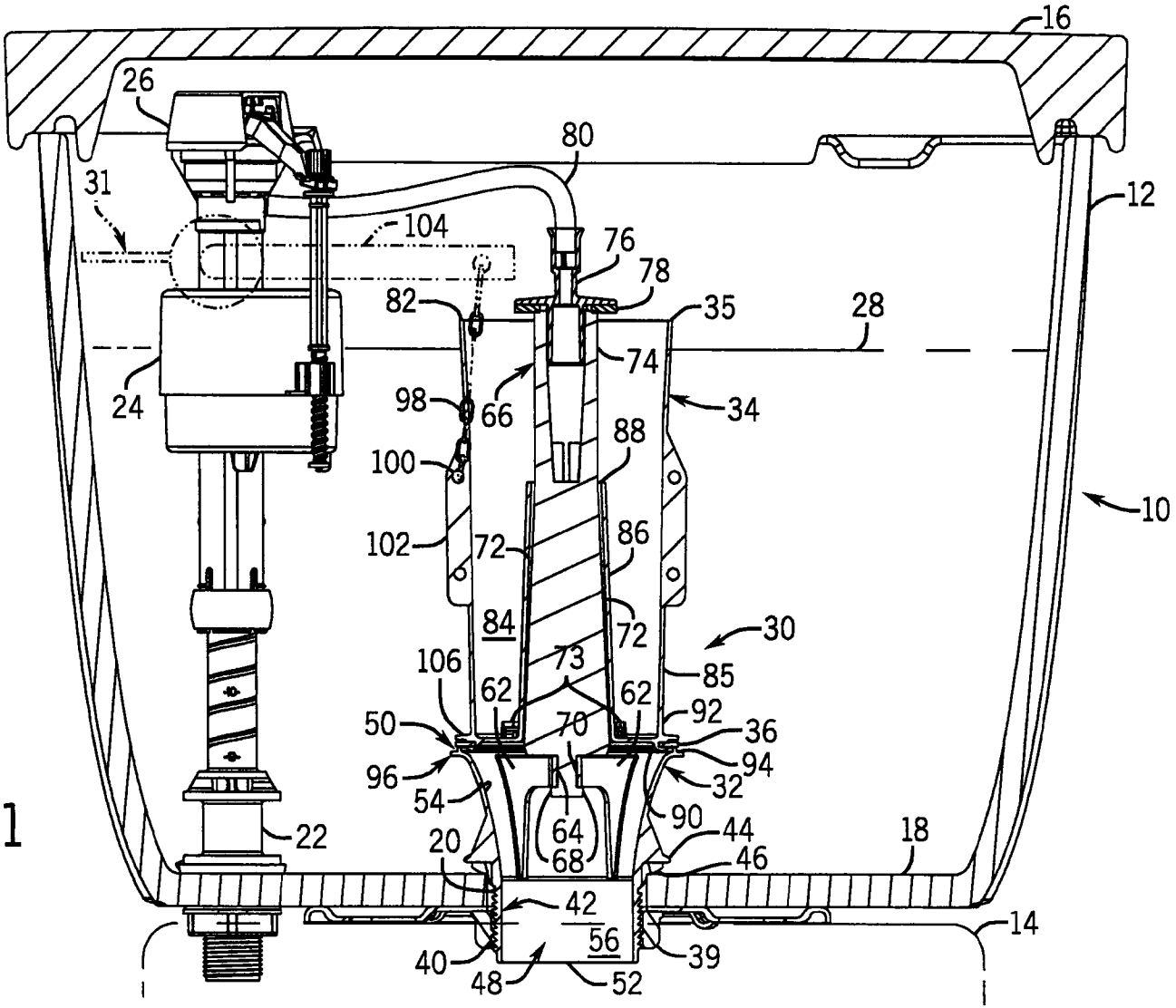
FIG. 1 is a sectional view depicting a flush valve of the present invention installed in a toilet tank of the present invention.
Figure 2:
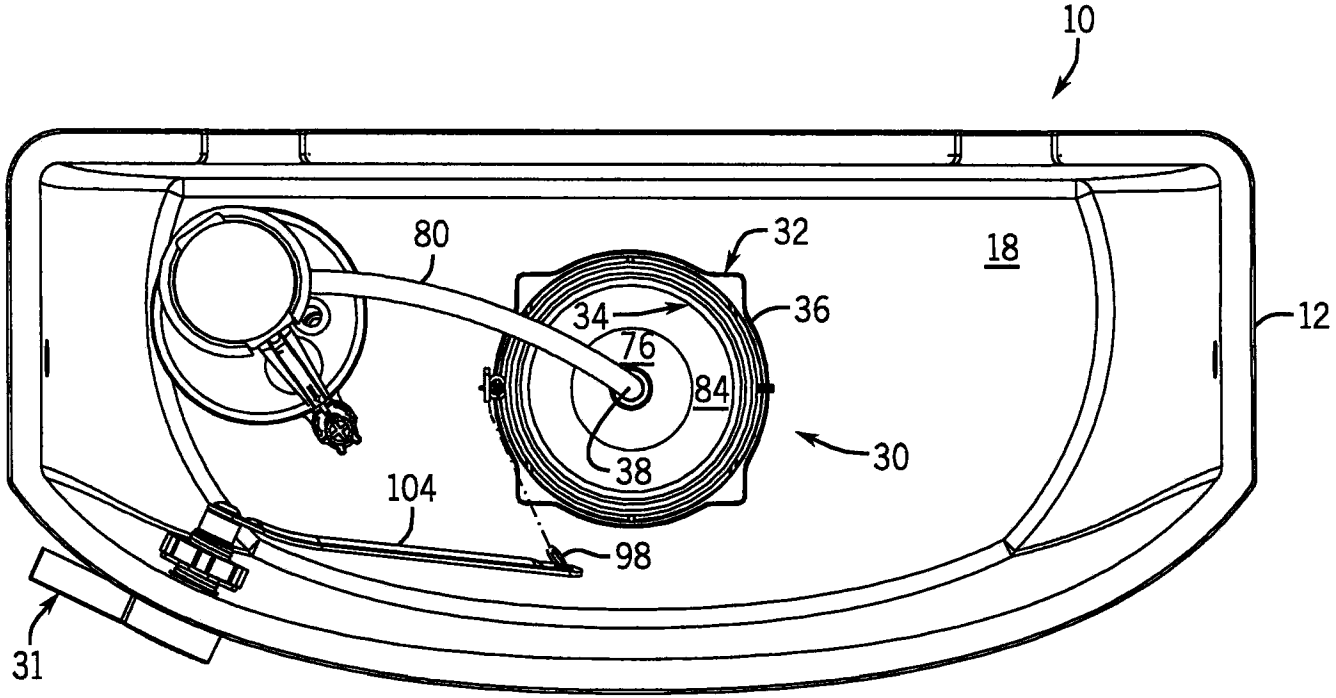
FIG. 2 is a top plan view of the FIG. 1, with the tank cover removed.

Referring first to FIGS. 1 and 2, a toilet 10 is shown that includes a water tank 12 and a bowl 14 (partially shown in hidden lines). The tank 12 may be coupled to the bowl 14 using a bracket like that of U.S. Pat. No. 6,728,976.

The tank 12 includes a cover 16 and a generally horizontal bottom wall 18 with an outlet opening 20 that leads to a channel in an upper rim (not shown) of the bowl 14. Mounted inside the tank is the typical water supply pipe 22 with a float 24 operated supply valve 26 for controlling the flow of supply water 28 into the tank 12. In this regard, when the float drops (as water has exited the tank), water is supplied to the tank. Once the float follows the water back up far enough, the supply water automatically turns off.

A flush valve assembly 30 in accordance with the present invention is mounted inside the tank 12 over the outlet opening 20 to control the flow of water 28 out from the tank 12 to the bowl 14 during a flush cycle. A trip lever assembly 31 is coupled to the tank 12 and to a portion of the flush valve assembly 30 and can be triggered to initiate a flush cycle.

Figure 3:
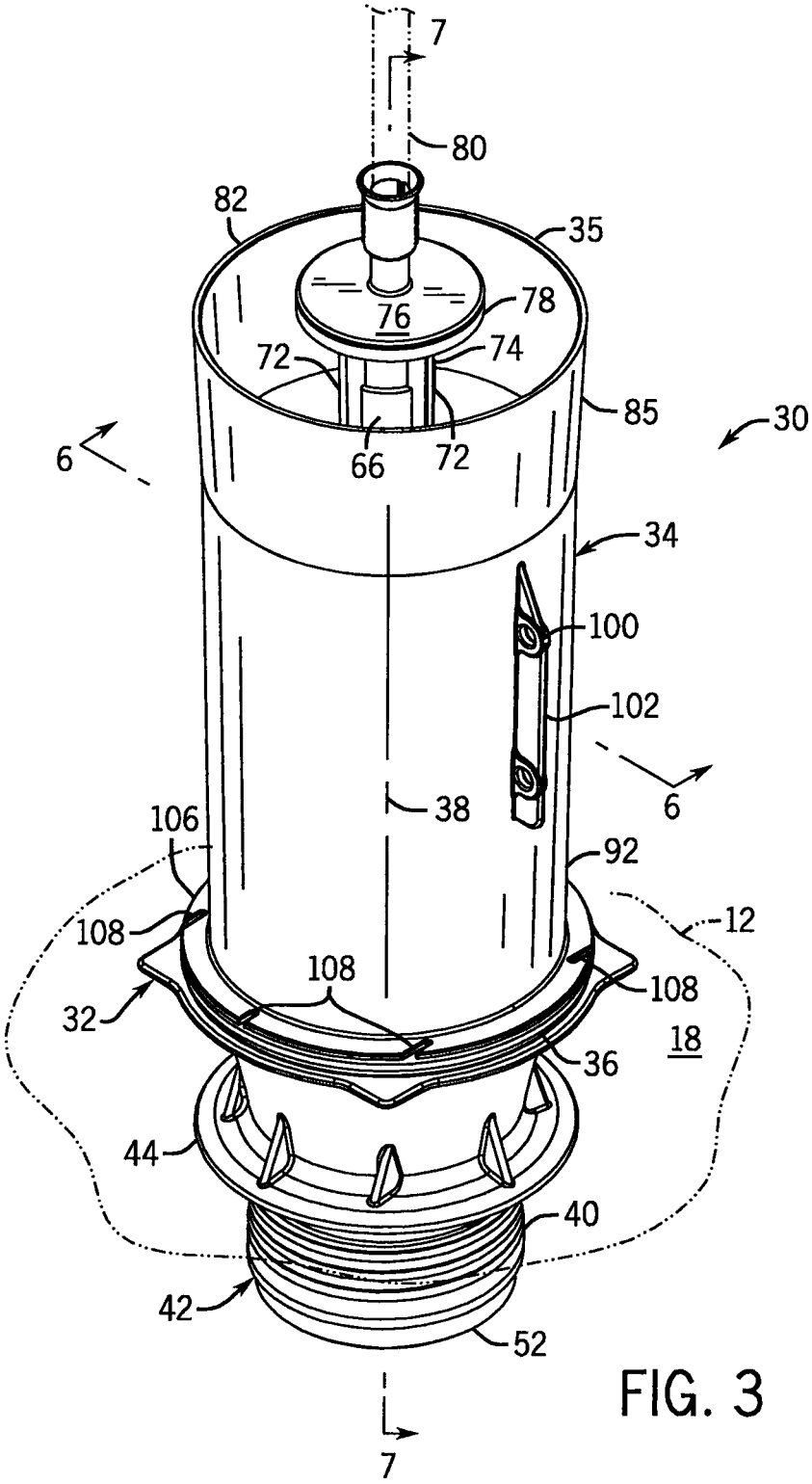
FIG. 3 is a perspective view of the FIG. 1 flush valve.
Figure 4:
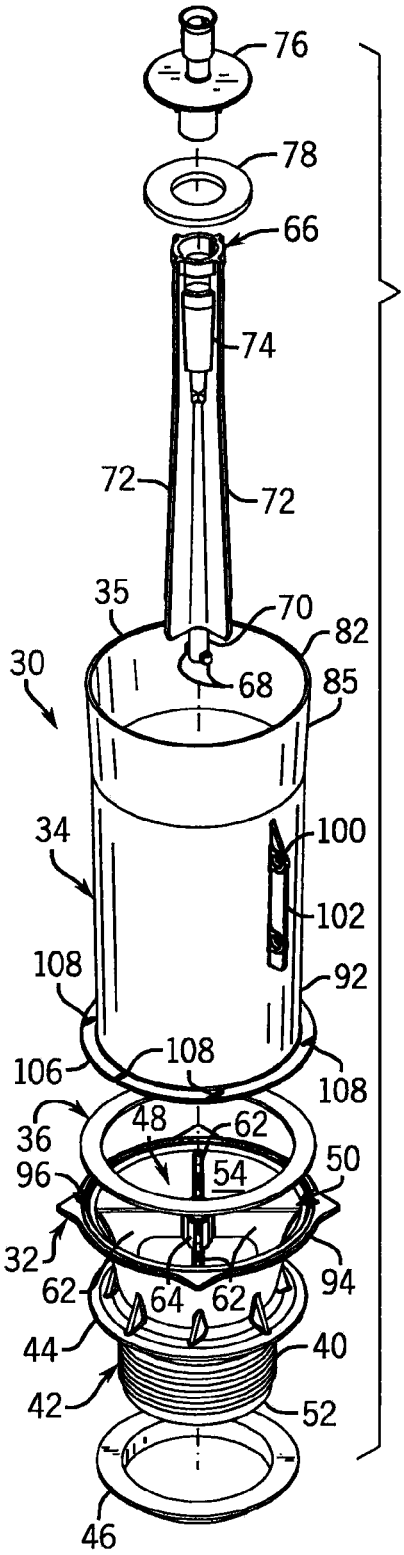
FIG. 4 is an exploded perspective view of the FIG. 2 flush valve.
Figure 5:
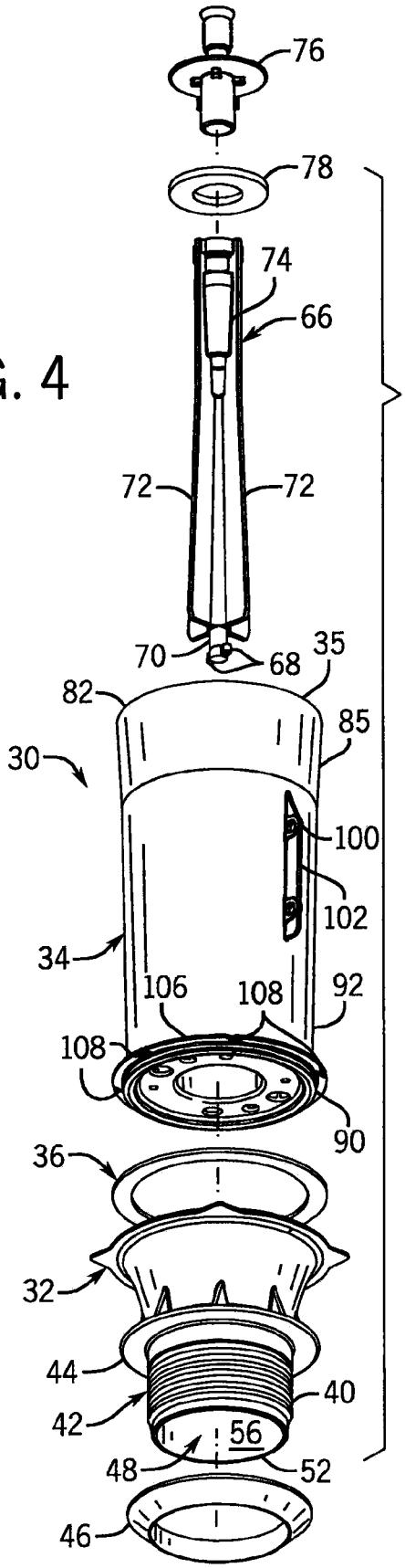
FIG. 5 is a view similar to FIG. 4, but showing the parts from a different angle.

With additional reference to FIGS. 3-5, the flush valve assembly 30 is mounted vertically upright in the tank 12 proximate the bottom wall 18. The flush valve assembly 30 primarily includes a mounting 32 and a valve body 34 incorporating a seal 36 that moves relative to the mounting 32 generally along a central axis 38 (shown in FIGS. 2 and 3). The mounting 32 and the valve body 34 are preferably constructed of a non-corrosive, chemical resistant material, such as a suitable plastic. The seal 36 can be made of a flexible material, for example a suitable elastomer, such as vinyl, EPDM rubber, or silicon, which has particularly good chemical/corrosion resistance properties. However, one skilled in the art will appreciate the variety of materials suitable for the mounting 32, valve body 34, and seal 36.

The mounting 32 is coupled to the tank 12 by a retaining nut 39 that threads onto exterior threads 40 formed proximate the lower portion 42 of the mounting 32 that extends through the tank outlet opening 20. An annular flange 44 extends radially from the mounting 32 to sandwich a gasket 46 between the bottom wall 18 of the tank 12 and the flange 44 (best shown in FIG. 1). This gasket 46 prevents water 28 from leaking from the tank 12 and, for instance, onto the floor of a bathroom.

In one alternate example configuration not shown, the lower portion 42 of the mounting 32 can have three prongs that extend through a trilobular opening and engage the tank 12. This connection is similar to that disclosed in U.S. Pat. No. 4,433,446, which is assigned to the assignee of the present invention, and the disclosure of which, particularly FIGS. 2-6 and the related description, is hereby incorporated by reference.

Figure 6:
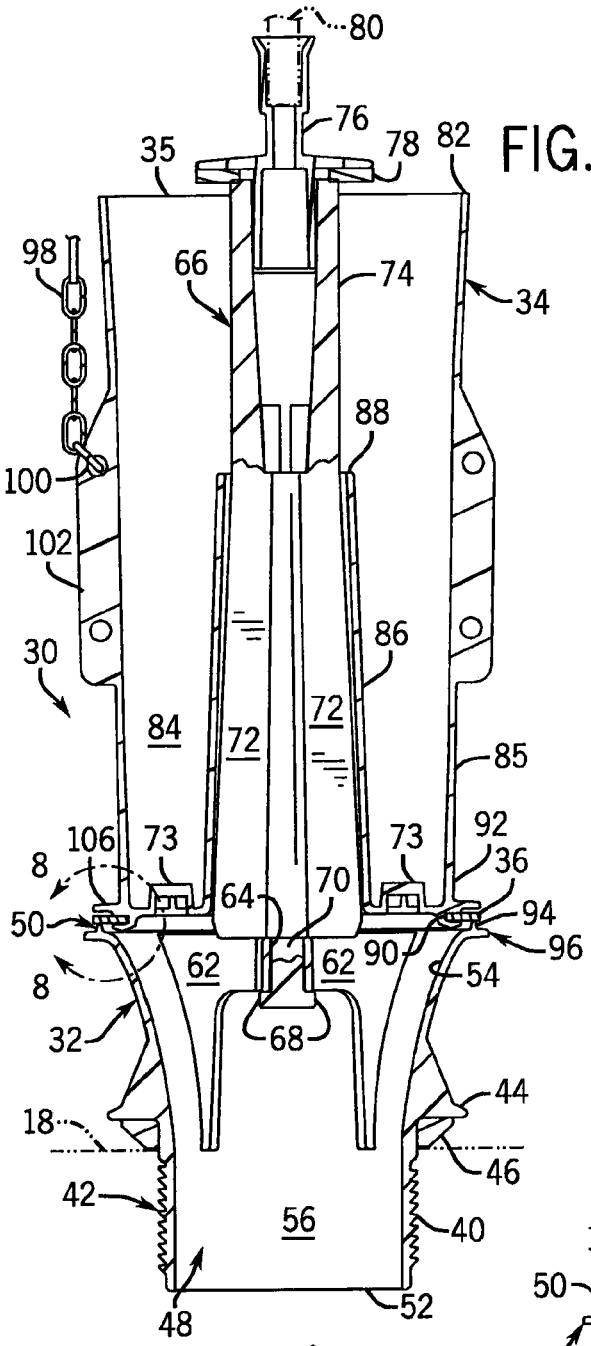
FIG. 6 is a sectional view taken along line 6-6 of FIG. 3.

With additional reference to FIGS. 6-11, the mounting 32 defines a passageway 48 that extends between a valve seat 50 at one end and a valve outlet 52 at the opposite end. The passageway 48 defines a substantially arcuate surface 54 that tapers down from the valve seat 50 toward the valve outlet 52, as best shown in FIG. 6. The arcuate surface 54 may be smooth to minimize impediment to the flow of water 28. Additionally, the arcuate surface 54 is preferably contoured to mimic the natural flow of water 28 so as to maximize the flow rate of the water 28 from the tank 12 to the bowl 14. The passageway 48 includes a linear portion 56 proximate the valve outlet 52; however, the passageway 48 may be entirely arcuate from the valve seat 50 to the valve outlet 52.

In the preferred example embodiment, the valve seat 50 and the valve outlet 52 are preferably concentric with respect to a central axis 38. The valve seat 50 is substantially circular and has a valve seat diameter 58 that is greater than a valve outlet diameter 60 (shown in FIGS. 9 and 10). The valve outlet 52 is also substantially circular.

In the example embodiment, the valve seat diameter 58 is approximately three inches to allow for a sufficient amount of water 28 to flow both during the initial inrush of a flush cycle and during the balance of the flush cycle. The passageway 48 reduces the larger valve seat diameter 58 to a valve outlet diameter 60 of approximately two inches proximate the valve outlet 52. As a result, the passageway 48 funnels or directs the water 28 toward the bowl 14, providing sufficient bowl 14 cleaning and waste removal water 28 during a flush cycle, and to permit coupling the mounting 32 to more traditional components and fixtures.

The passageway 48 may take on a variety of arcuate surface configurations of reducing cross section, with each having a goal of efficiently transferring water 28 from the tank 12 to the bowl 14 during a flush cycle. The tapered passageway 48 has the added benefit of making the mounting 32 compatible with standard bowls and other coupling components, while allowing the enhanced flow of water 28.

The mounting 32 includes a series of supports 62 in the form of arcuately tapered legs that extend inward from the passageway 48 and converge proximate the central axis 38 where they define an opening 64. The supports 62 taper below the valve seat 50 toward the valve outlet 52 to maximize the flow of water 28 through the passageway 48. The opening 64 is configured to receive a guide portion 66 in the form of a post. The guide portion 66 has a pair of legs 68 formed proximate a lower end 70 that selectively lock into the opening 64 to prevent axial movement of the guide portion 66.

The guide portion 66 also includes upwardly extending tapered gussets 72 that terminate in a hollow upper end 74 that is configured to receive a refill nozzle 76 and stop washer 78 that captures the valve body 34 to the guide portion 66. During a flush cycle, the refill nozzle 76 receives water 28 from the supply valve 26 via tube 80. The refill nozzle 76 allows water 28 to fill a portion of the valve body 34 and tank 12 during a flush cycle to influence the duration of the flush cycle and to restore the bowl water to an initial level.

The substantially cup-shaped valve body 34 is a type of float that is open to the ambient at a top 35 and includes an exterior wall 85 and an interior tube 86 that generally rides along the guide portion 66 during a flush cycle. The interior tube 86 is substantially conical and tapers toward an upper rim 88 of the tube 86. The conical configuration of the interior tube 86 acts to center the valve body 34 with respect to the mounting 32 as the valve body 34 sinks from the raised position to the lowered position. Should water 28 breach the upper rim 82 of the valve body 34, the water 28 begins to fill a circular pocket 84 formed between the interior tube 86 and the exterior wall 85. The water 28 drains through openings 73 first and then climbs to upper rim 88 of the interior tube 86 if the incoming overflow rate is high enough. Note also gussets 72.

The trip lever assembly 31 includes a chain 98 that is hooked between hole 100 formed in a side tab 102 of the valve body 34 and the trip arm 104, as a result, actuating the trip lever assembly 31 moves the valve body 34 from the lowered position (shown in FIG. 6) toward the raised position (shown in FIG. 11).

Figure 7:
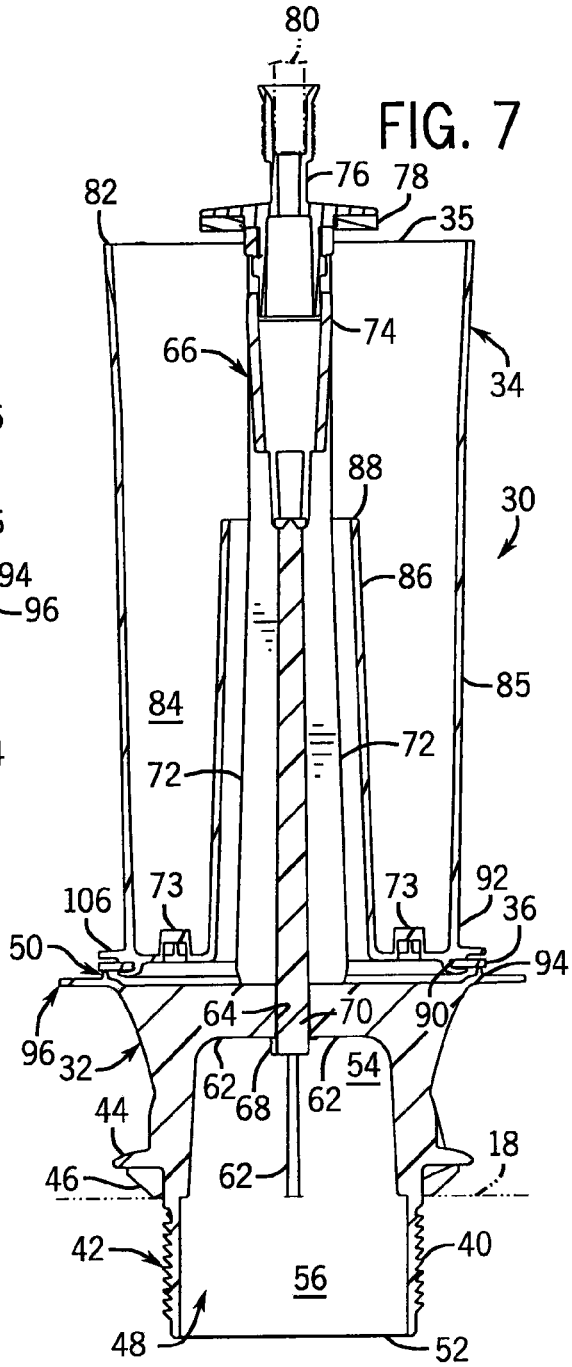
FIG. 7 is a sectional view taken along line 7-7 of FIG. 3.
Figure 8:
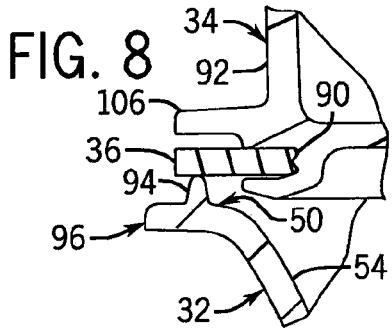
FIG. 8 is an enlarged detail view per arc 8-8 of FIG. 6.

With specific reference to FIGS. 6-8, when the valve body 34 is in the lowered position, the seal 36 prevents water 28 from leaking from the tank 12 to the bowl 14 proximate a perimeter 96 of the mounting 32. The typically disk-shaped seal 36 is secured in an annular groove 90 formed proximate the lower end 92 of the valve body 34. In the preferred example embodiment, the seal 36 at least partially engages a ridge 94 that extends upward from the valve seat 50 proximate the perimeter 96 of the valve seat 50 (shown best in FIG. 8) to help establish a watertight seal between the seal 36 and the valve seat 50. Furthermore, an annular seal-backing flange 106 is spaced apart from the seal 36 and enhances the operation and sealing of the seal 36. Additionally, a series of slots 108 are formed in the seal-backing flange 106 to enhance the operation of the valve body 34 during a flush cycle. One skilled in the art will appreciate the variety of configurations available to retain the seal 36 to the valve body 34.

The bleed openings 73, seal-backing flange 106, slots 108, and other additional structures are discussed in U.S. patent application number 2007/0101485 that is assigned to the assignee of the present invention, which is hereby incorporated by reference as if fully set forth herein.

Prior to a flush cycle the flush valve is in the rest position shown in FIGS. 1, 3, 6, and 7, with the valve body 34 and seal 36 seated on the valve seat 50 and a "full" tank 12 of water 28 available. Actuating the trip lever assembly 31 pulls the valve body 34 upwardly a sufficient distance to cause the seal 36 to unseat from the valve seat 50. When the seal 36 is initially unseated from the valve seat 50, the flared valve seat 50 portion of the passageway 48 allows the water 28 to flow into the bowl 14 with an initial inrush equivalent to a valve of uniform diameter of valve seat 50.

Through the buoyancy of the valve body 34, the valve body 34 is moved further toward the raised position shown in FIG. 11. The water 28 in the tank 12 continues to flow through the mounting 32 along the arcuate surface 54 of the passageway 48 that mimics the natural flow of water 28 toward the bowl 14. Additionally, the tapered supports 62 minimize water 28 flow resistance in the passageway 48. Water 28 and waste in the bowl 14 are evacuated to plumbing waste lines in the usual manner through a trap (not shown). The valve body 34 travels down the guide portion 66 until the seal 36 again seats in the valve seat 50 in conjunction with an engineered bleed rate controlled by openings 73. The flush cycle completes after the tank 12 is refilled with water 28 sufficient to trip the supply valve 26.

It should be appreciated that preferred embodiments of the invention have been described above. However, many modifications and variations to the preferred embodiments will be apparent to those skilled in the art, which will be within the spirit and scope of the invention. Therefore, the invention should not be limited to the described embodiments. To ascertain the full scope of the invention, the following claims should be referenced.

INDUSTRIAL APPLICABILITY

The present invention provides improved valves for use in controlling outflow of water from a toilet tank to a toilet bowl, and toilets which incorporate these valves.

What is claimed is:

1. A flush valve for controlling a flow of water out through a hole in a wall of a toilet tank, the flush valve comprising:

a mounting having a lower end suitable for facilitating installation of the mounting adjacent the hole, an upper end in a form of a valve seat, a through passage extending down from the valve seat, and a guide portion mounted in the through passage and extending upward therefrom, and a valve body positionable over the valve seat so as to be suitable to inhibit water flow through the mounting when in a first position where the valve body is positioned on the valve seat, and so as to be suitable to permit water flow through the mounting when the valve body is in a second position where the valve body is not positioned on the valve seat, the valve body being open at a top end and having a bottom wall that defines a pocket configured to receive water through the open top end;

wherein the valve seat is positioned above the through passage, and the through passage arcuately narrows below the valve seat; and wherein the mounting includes a leg structure having upper and lower portions that are arcuately tapered along an inner surface of the through passage; and wherein the upper portion extends a first radial distance from the inner surface and the lower portion extends a second radial distance from the inner surface that is less than the first.

2. The flush valve of claim 1, wherein the through passage arcuately narrows below the valve seat from a diameter greater than 2.9 inches to a diameter less than 2.3 inches.

3. The flush valve of claim 1, wherein the valve body is a canister valve body.

4. A flush valve for controlling a flow of water out through a hole in a wall of a toilet tank, the flush valve comprising:

a mounting having a lower end suitable for facilitating installation of the mounting adjacent the hole, an upper end in a form of a valve seat, a through passage extending down from the valve seat, and a guide portion mounted in the through passage and extending upward therefrom; and a valve body positionable over the valve seat so as to be suitable to inhibit water flow through the mounting when in a first position where the valve body is positioned on the valve seat, and so as to be suitable to permit water flow through the mounting when the valve body is in a second position where the valve body is not positioned on the valve seat;

wherein the valve seat is positioned above the through passage, and the through passage arcuately narrows below the valve seat;

wherein the mounting has a lower leg structure having upper and lower portions that taper arcuately below the valve seat along an inner surface of the through passage;

wherein the upper portion extends a first radial distance from the inner surface and the lower portion extends a second radial distance from the inner surface that is less than the first; and wherein the guide portion is fixed in an axial direction relative to the lower leg structure.

5. The flush valve of claim 1, wherein the mounting has external threads proximate a lower end of the mounting so as to facilitate installation of the mounting through the tank hole.

6. A toilet comprising:

a bowl;

a tank for storing water, the tank having a lower outlet hole for permitting water to pass from the tank to the bowl; and a flush valve mounted to the outlet hole, the flush valve comprising:

a mounting having a lower end suitable for facilitating installation of the mounting adjacent the hole, an upper end in a form of a valve seat, a through passage extending down from the valve seat, and a guide portion mounted in the through passage and extending upward therefrom, and a valve body positionable over the valve seat so as to be suitable to inhibit water flow through the mounting when in a first position where the valve body is positioned on the valve seat, and so as to be suitable to permit water flow through the mounting when the valve body is in a second position where the valve body is not positioned on the valve seat, the valve body being open at a top end and having a bottom wall that defines a pocket configured to receive water through the open top end;

wherein the valve seat is positioned above the through passage, and the through passage arcuately narrows below the valve seat;

wherein the mounting has a lower leg structure having upper and lower portions that taper arcuately below the valve seat along an inner surface of the through passage; and wherein the upper portion extends a first radial distance from the inner surface and the lower portion extends a second radial distance from the inner surface that is less than the first.

7. The flush valve of claim 1, wherein the pocket has a circular cross section.

8. The flush valve of claim 1, wherein the valve body comprises an exterior wall and an inner tube, the pocket being formed between the exterior wall and the inner tube.

9. The flush valve of claim 8, wherein the inner tube is configured to ride along the guide portion during a flush cycle.

10. The flush valve of claim 8, wherein the bottom wall of the valve body extends between the exterior wall and the inner tube, the bottom wall defining at least one opening through which water is configured to drain.

11. The flush valve of claim 1, wherein the through passage includes a linear portion proximate the lower end of the mounting.

12. The flush valve of claim 11, wherein the through passage arcuately narrows in a continuous manner until reaching the linear portion.

13. The flush valve of claim 4, wherein the mounting has a plurality of lower leg structures, each lower leg structure tapering arcuately below the valve seat along the inner surface of the through passage.

14. The flush valve of claim 13, wherein the plurality of lower leg structures converge proximate a central axis of the mounting to define an opening configured to receive the guide portion.

15. The flush valve of claim 14, wherein the guide portion is in the form of a post having at least one projection that selectively locks the post within the opening in the axial direction.

16. The flush valve of claim 4, wherein the lower leg structure tapers arcuately in a vertical direction a distance that is substantially equal to a distance that the through passage arcuately narrows in the vertical direction.

17. The flush valve of claim 4, wherein the through passage includes a linear portion.

18. The flush valve of claim 17, wherein the linear portion is provided near a valve outlet.

19. The flush valve of claim 18, wherein the linear portion starts at a bottom portion of the lower leg structure.

20. A toilet comprising:

a bowl;

a tank for storing water, the tank having a lower outlet hole for permitting water to pass from the tank to the bowl; and a flush valve mounted to the outlet hole, the flush valve comprising:

a mounting having a lower end suitable for facilitating installation of the mounting adjacent the hole, an upper end in a form of a valve seat, a through passage extending down from the valve seat, and a guide portion mounted in the through passage and extending upward therefrom; and a valve body positionable over the valve seat so as to be suitable to inhibit water flow through the mounting when in a first position where the valve body is positioned on the valve seat, and so as to be suitable to permit water flow through the mounting when the valve body is in a second position where the valve body is not positioned on the valve seat;

wherein valve seat is positioned above the through passage, and the through passage arcuately narrows below the valve seat;

wherein the mounting has a lower leg structure having upper and lower portions that taper arcuately below the valve seat along an inner surface of the through passage;

wherein the upper portion extends a first radial distance from the inner surface and the lower portion extends a second radial distance from the inner surface that is less than the first; and wherein the guide portion is fixed in an axial direction relative to the lower leg structure.

21. The flush valve of claim 1, wherein the valve body does not engage the through passage.

22. The flush valve of claim 4, wherein the lower portion extends downward and tapers away from the axial direction.

23. The flush valve to of claim 13, wherein each leg structure includes an upper portion and a lower portion, which are coupled to and taper arcuately along an inner surface of the through passage;

wherein the upper portion of each leg structure extends radially inward from the inner surface a first distance and the lower portion of each leg structure extends radially inward from the inner surface a second distance that is less than the first.

* * * * *

UNITED STATES PATENT AND TRADEMARK OFFICE

CERTIFICATE OF CORRECTION

PATENT NO. : 8,806,669 B2
APPLICATION NO. : 12/416179
DATED : August 19, 2014
INVENTOR(S) : Halloran et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 451 days.

Signed and Sealed this
Eleventh Day of August, 2015

Michelle K. Lee

Michelle K. Lee
*Director of the United States Patent and Trademark Office*